United States Patent [19]

DeSantis

[11] 4,401,614

[45] Aug. 30, 1983

[54] ANVIL ASSEMBLY FOR A POWDER-COMPACTING ANVIL PRESS

[75] Inventor: Raymond P. DeSantis, Troy, Mich.

[73] Assignee: PTX-Pentronix, Inc., Lincoln Park, Mich.

[21] Appl. No.: 300,577

[22] Filed: Sep. 8, 1981

[51] Int. Cl.[3] ..... B30B 11/02

[52] U.S. Cl. ..... 264/109; 264/120; 425/78; 425/352; 425/354; 425/355; 425/385; 425/394; 425/406; 425/410; 425/411; 425/412

[58] Field of Search ..... 264/109, 120; 425/78, 425/352, 354, 355, 385, 394, 406, 410, 411, 412, 425 DIG 44 DIG. 44

[56] References Cited

U.S. PATENT DOCUMENTS

| | | | |
|---|---|---|---|
| 2,336,982 | 12/1943 | Cremen | 425/78 |
| 3,328,840 | 7/1967 | Vinson | 425/228 |
| 3,344,213 | 9/1967 | Vinson | 264/39 |
| 3,415,142 | 12/1968 | Vinson | 74/568 |
| 3,561,056 | 2/1971 | Smith et al. | 425/168 |
| 3,574,892 | 4/1971 | Smith | 425/155 |
| 3,645,658 | 2/1972 | De Troyer | 425/139 |
| 3,664,785 | 5/1972 | Marshall et al. | 425/78 |
| 3,726,622 | 4/1973 | De Troyer et al. | 425/193 |
| 3,730,659 | 5/1973 | Smith et al. | 425/78 |
| 3,775,032 | 11/1973 | Smith et al. | 425/78 |
| 3,826,559 | 7/1974 | Berliner et al. | 350/86 |
| 4,053,267 | 10/1977 | De Santis | 425/78 |

*Primary Examiner*—Maurice J. Welsh
*Attorney, Agent, or Firm*—Hauke & Patalidis

[57] ABSTRACT

In an anvil assembly for powder-compacting press wherein an article is compacted of powder material against the face of the anvil clamped in position over a die cavity filled with powdered material, a reciprocable punch being disposed at the bottom of the die cavity for compacting the powdered material against the anvil face, the anvil is provided with a movable face portion which, during compaction of the powder material, is displaced away from the die cavity, compressing an elastomeric return spring.

15 Claims, 9 Drawing Figures

ANVIL ASSEMBLY FOR A POWDER-COMPACTING ANVIL PRESS

BACKGROUND OF THE INVENTION

I. Field of the Invention

The present invention relates to powder compacting apparatus and, more particularly, to an apparatus which produces a compacted article within very close dimensional tolerances and with broken corners, beveled or radiused, between a face of the article and its side surfaces, for example.

II. Description of the Prior Art

The present invention is concerned with improved tooling for use in powder-compacting presses such as are disclosed in U.S. Pat. Nos. 3,826,559; 3,775,032; 3,730,659; 3,726,622; 3,645,658; 3,574,892; 3,561,056; 3,415,142; 3,344,213; and 3,328,840, all of which are assigned to the same assignee as the present application.

In the powder-compacting presses disclosed in the aforementioned U.S. patents, articls are compacted and formed in a single or multi-cavity die forming part of a punch and die set, with the finished articles being automatically ejected from the die cavities, picked up by a vacuum pick-up head, and conveyed into suitable receptacles. A work station positioner assembly, which is part of the press, is mounted linearly or angularly movable transversely over the die plate and carries a powder dispenser, an anvil and the pick-up head. The powder dispenser, which is supplied with powder from a primary powder supply means connected thereto by means of a flexible tubing or the like, is first positioned over the die cavity or cavities which are thus filled with powder as the punch or punches are displaced downwardly so as to draw a predetermined amount of powder into the die cavity or cavities. The powder dispenser is then removed from above the die cavity or cavities by the subsequent angular motion of the station positioner assembly, and the anvil is, in turn, positioned over the cavity or cavities. The anvil is clamped over the die cavity or cavities by means of a clamp supported above the anvil and actuated in timed relation with the movement of the punches. The anvil is held down with sufficient pressure to permit compaction of the powder against the anvil as a result of an upward motion of the punch or punches into the die cavity or cavities. The anvil is then removed from its position over the die cavity or cavities and is replaced by the pick-up head, as a result of a further linear or angular motion of the work station positioner across the face of the die plate. Each punch is displaced upwardly so as to bring its upper end in substantial flush alignment with the upper surface of the die plate, such that the finished compacted articles are ejected from the die cavity or cavities and picked up by the pick-up head for transfer to appropriate containers.

In U.S. Pat. Nos. 3,775,032, 3,826,599, 4,047,864, 4,061,452, 4,061,453 and 4,230,653, also assigned to the same assignee as the present application, tooling arrangements for compacting articles from powder material are described in which a mold cavity is defined partly by the end face of an upper punch projecting through an anvil element above the die cavity, partly by the die bore wall and partly by the end face of the lower punch.

SUMMARY OF THE INVENTION

The present invention provides improved tooling for compacting articles made of powder materials. The present invention accomplishes its objects by providing a molding apparatus for compacting powder material in the form of a die having a die cavity, and a punch reciprocably movable in the die cavity for compressing powder material filling the die cavity by way of an upwardly directed stroke of the punch. The anvil face against which the powder material is compacted has a movable portion and a stationary portion such that the article is compacted with a portion of its upper face in engagement with the stationary portion of the anvil face and another portion in engagement with the movable portion of the anvil face. The movable portion of the anvil face is in the form of a pad which is movable from a position where it is substantially flush with the opening of the die cavity to a position away from the die cavity resulting in engagement of the movable pad anvil with an abutment preventing further motion. During motion of the movable portion of the anvil face, a spring, preferably an elastomeric spring, is compressed such that, upon relieving the pressure from the face of the movable portion of the anvil, the anvil movable portion is returned to its original position.

The diverse objects and advantages of the present invention will become apparent to those skilled in the art when the following description of the best mode contemplated for practicing the invention is read in conjunction with the accompanying drawings, wherein like reference numerals refer to like or equivalent elements and in which:

DETAILED DESCRIPTION OF THE PREFERRED EMBODIMENTS

Figure 1:
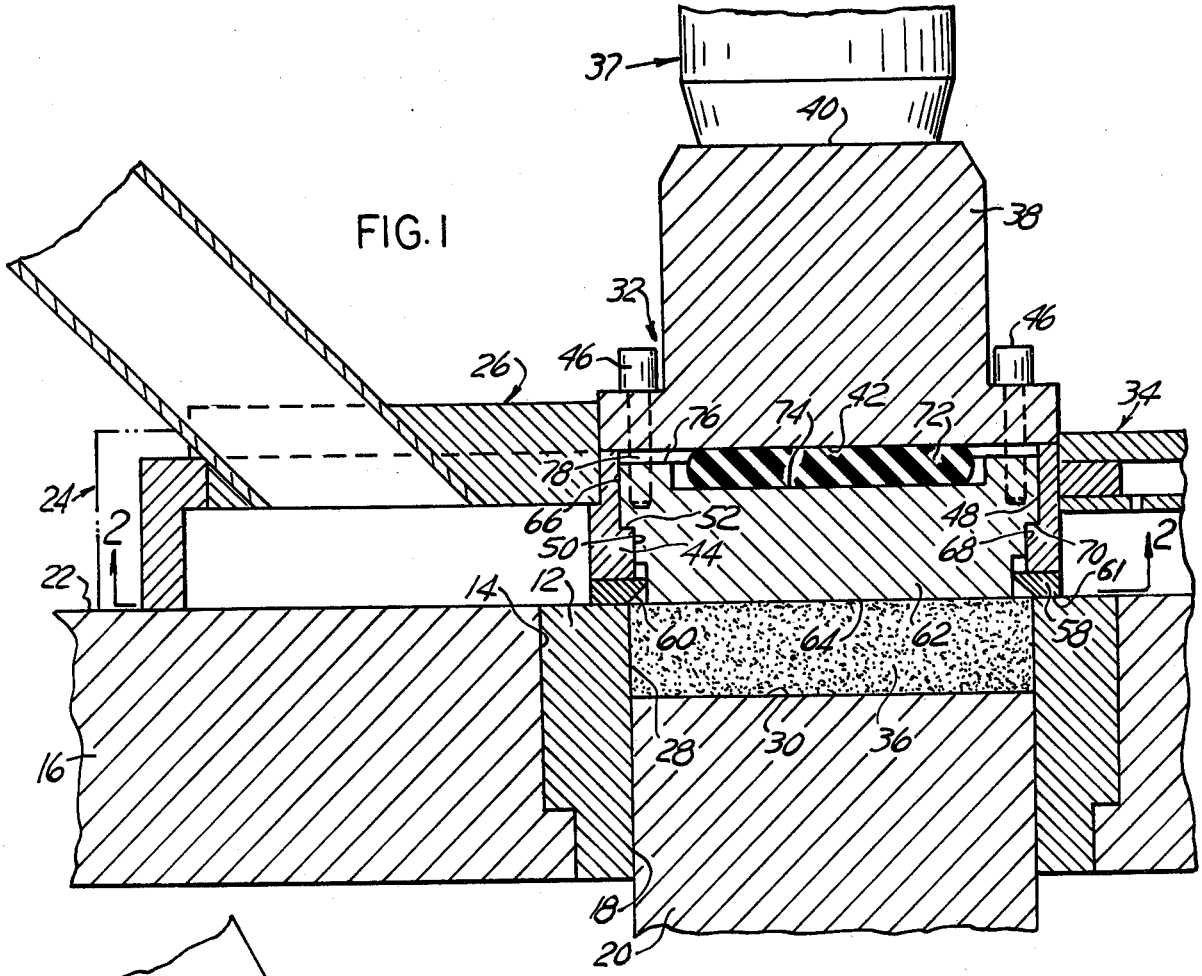
FIG. 1 is a partial broken sectional view of a powder compacting apparatus according to the present invention.
Figure 2:
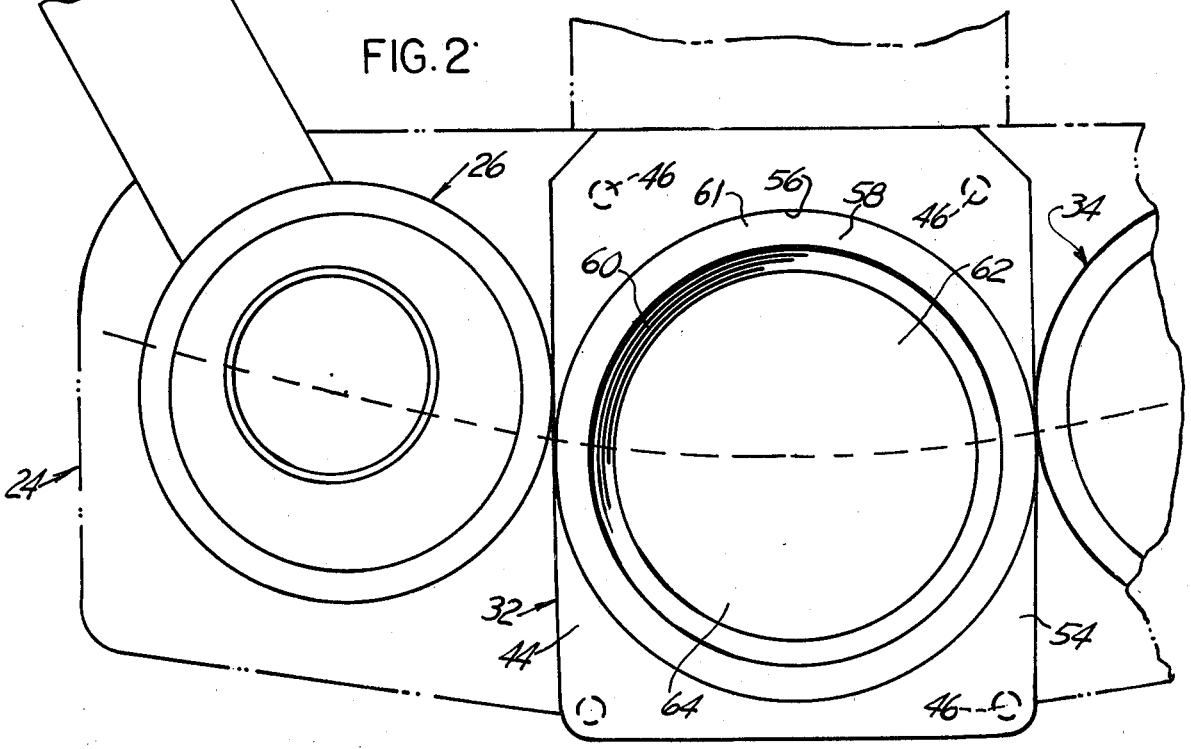
FIG. 2 is a broken bottom elevation view from line 2—2 of FIG. 1.

Referring now to the drawings, and more particularly, to FIGS. 1–2 thereof, there is illustrated, in a somewhat schematic manner, an apparatus for compacting articles from powder material. The compacting apparatus comprises a die consisting of a die bushing 12 press-fitted, cemented or otherwise mounted in a bore 14 in a die plate 16. The die bushing 12, which is preferably made of a hard material such as tungsten carbide or the like, is provided with a bore 18 in which a punch 20 is mounted reciprocable. The punch 20 is actuated by an appropriate mechanism of the powder-compacting press, not shown, such as a cam or a pivotable treadle actuated by a cam mounted on a camshaft.

The die plate 16, made, for example, of heat-treated alloy steel, and the die bushing 12 are provided with a highly polished upper surface 22 above which is mounted a work station positioner assembly 24. The work station positioner supports a powder dispenser or hopper 26, adapted to supply powder material to the die cavity 28 defined in the die bore 18 above the upper face 30 of the punch 20. An anvil assembly 32 and a part pick-up head 34 for picking up the compacted articles after ejection from the die cavity 28, also supported by the work station positioner 24.

As is well known in the art, the work station positioner 24 is displaceable linearly or arcuately over the die plate upper surface 22 such as to sequentially place over the die cavity 28 the powder hopper 26 to fill the die cavity with powder material and the anvil assembly 32, after the die cavity 28 has been filled with an appropriate amount of powder material, as shown at 36 at FIG. 1 which represents the relative position of the elements preparatory to compacting the powder material 36 in the die cavity 28, the anvil assembly 32 being clamped over the die cavity 28 by a clamp 37 actuated by the mechanism of the powder-compacting press, not shown.

The anvil assembly 32 comprises a solid block 38 having an upper face 40 engageable by the end face of the clamp 37, and a lower face 42 to which a housing 44 is fastened by any convenient means such as bolts or screws 46. The housing 44 has a relatively large diameter bore 48 located at its top and a relatively small diameter bore 50 located at its bottom, such that an annular shoulder abutment 52 is disposed at the junction of the large diameter and small diameter bores 48 and 50. The lower face 54 of the housing 44, FIG. 2, has an annular groove 56 in which is press-fitted and cemented, or otherwise fastened, a ring 58 made of an ultra hard material such as tungsten carbide for example which, in the example of structure illustrated, forms an opening having a tapered or beveled wall 60 diverging downwardly toward the die cavity 28, and a flat face 61 in engagement with the surface.

A displaceable anvil pad 62 is disposed within the housing 44. The anvil pad 62 has a flat end face 64 which, in the structure illustrated, is circular, and a large diameter portion 66 slidably fitting the larger diameter bore 48 of the housing 44, and a reduced diameter portion 68 slidably fitting the reduced diameter bore 50 of the housing 44. The larger diameter portion 66 and the reduced diameter portion 68 of the anvil pad 62 are separated by a shoulder annular portion 70 forming an abutment normally engaged with the shoulder annular abutment portion 52 separating the bores 48 and 50 of the housing 44 under the urging of an appropriate biasing means such as a compressed spring 72, for example. The spring 72 may take any convenient form, such as an air spring or a steel dashed washer-like Belleville spring, for example, but, preferably, it is in the form illustrated, namely a cushion pad made of an appropriate elastomeric material such as, for example, natural rubber, neoprene, polysiloxane, polyurethane, polysulfide rubber, polybutadiene, buna-S, and the like. The elastomeric spring pad 72 is compressibly disposed in a cavity 74 formed in the upper face 76 of the anvil pad 62. With the shoulder annular abutments 52 and 70 of the housing 44 of the anvil pad 62 in mutual engagement, the upper surface 76 of the anvil pad 62 is separated from the lower face 42 of the anvil block 38 by a clearance 78, as is shown at FIG. 1.

Figure 3:
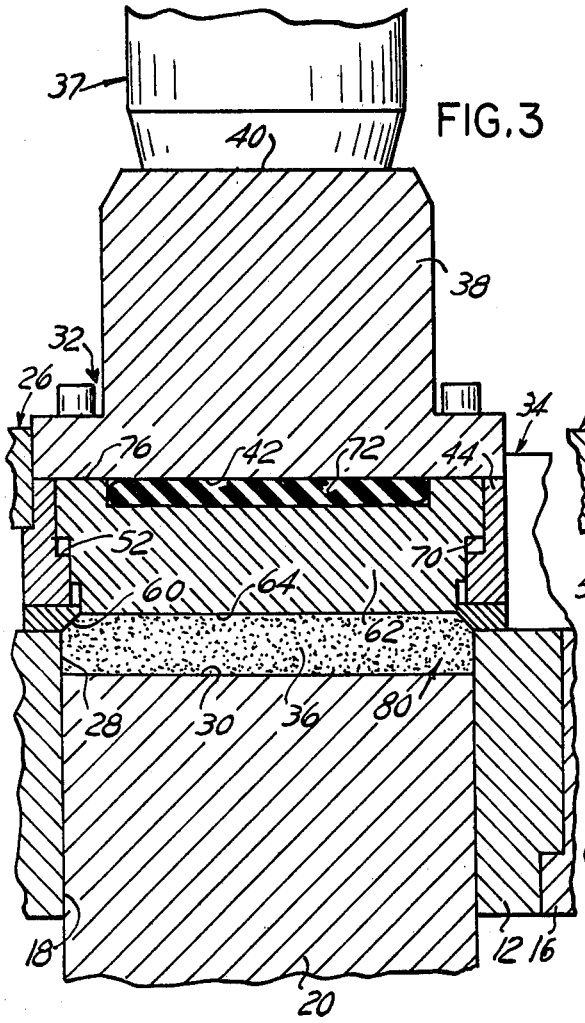
FIG. 3 is a partial broken sectional view similar to FIG. 1, but showing the compacted article in the process of being compacted by the apparatus of the invention.

As hereinbefore mentioned, FIG. 1 represents the step prior to compacting the powder material 36 disposed in the die cavity 28 above the face 30 of the reciprocable punch 20, the anvil assembly 32 being firmly clamped in position over the die cavity 28 by the clamp 37. The punch 20 is subsequently displaced upwardly to the position illustrated at FIG. 3, with the result that the powder material 36 in the die cavity 28 is partially compacted between the punch face 30 and the anvil pad face 64. The resulting pressure applied to the anvil pad face 64 causes the anvil pad 62 to be displaced upwardly, further compressing the elastomeric spring pad 72 until the upper surface 76 of the anvil pad 62 engages the lower face 42 of the anvil block 38. Further upward motion of the punch 22 finishes the compacting of the power material against the now solidly stationary face 64 of the anvil pad 62. The powder material 36 is thus compacted in a molding cavity having walls formed by the upper face 30 of the punch 20, the lower face 64 of the anvil pad 62, the wall of the die bore 18 and the beveled surface 60 of the ring 58. A compacted article 80 is thus formed with a beveled upper edge 82 corresponding to the beveled annular surface 60 of the ring 58.

Figure 4:
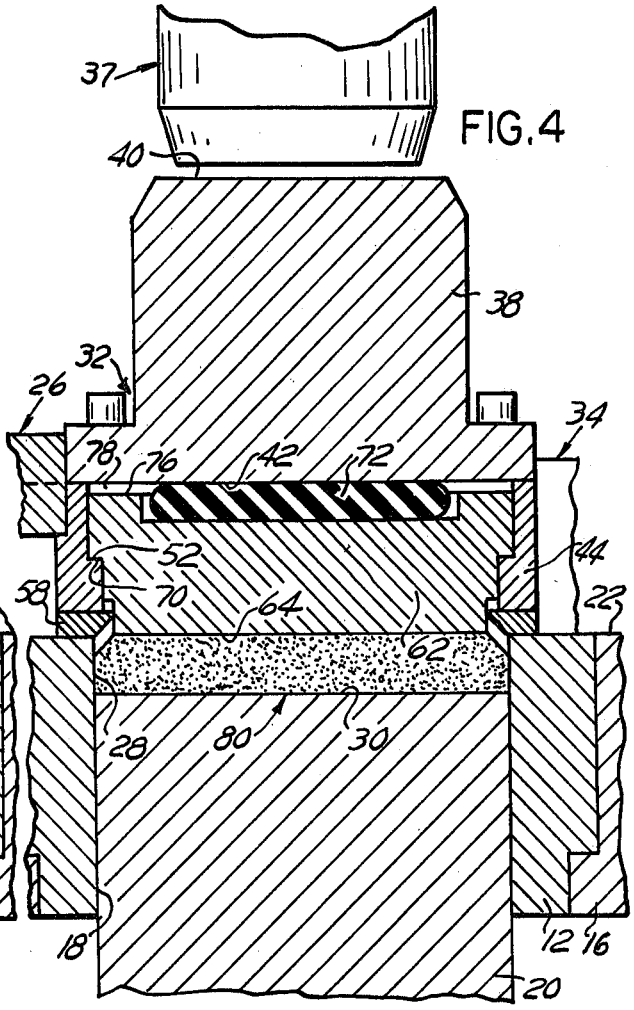
FIG. 4 is a view similar to FIG. 3 but showing the position of the respective elements prior to ejection of the compacted article.
Figure 5:
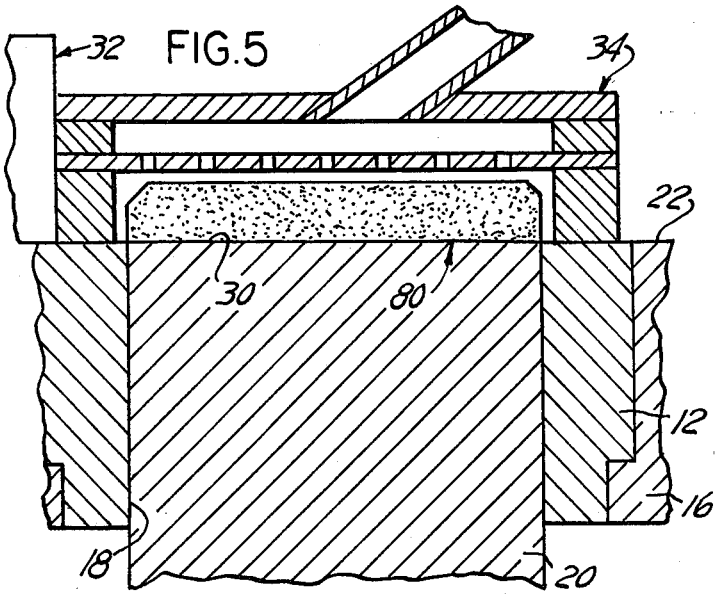
FIG. 5 is a view similar to FIG. 4 but illustrating the compacted article during the ejection step.

Subsequently thereto, the punch 20 is displaced downwardly, as illustrated at FIG. 4, while simultaneously allowing the elastomeic spring pad 72 to expand to its original thickness, thus displacing downwardly the anvil pad 62 with its face 64 remaining in engagement with the upper surface of the compacted article 80 such that the compacted article is maintained firmly sandwiched between the anvil pad face 64 and the punch face 30, until the annular abutment surfaces 70 and 52 of, respectively, the anvil pad 62 and the housing 44 are gain in engagement, resulting in the face 64 of the anvil 62 being substantially flush with the lower face of the ring 58 and the upper surface 22 of the die plate 16 and die bushing 12. The anvil assembly 32, after the clamp 37 has been lifted, as shown at FIG. 4, becomes free to be displaced by the work station positioner 24 in the appropriate direction placing the part pick-up head 34 over the die cavity 28. Subsequently thereto, and as illustrated at FIG. 5, the punch 20 is reciprocated upwardly until its end face 30 is substantially flush with the upper surface 22 of the die plate 16 and die bushing 12, thus ejecting the finished article 80 into the pick-up head 34, for transportation to an appropriate container. A subsequent motion of the work station positioner 24 places the powder hopper 26 over the die cavity 28 for filling the die cavity 28 with powder material, and a further motion of the work station positioner places the anvil assembly 32 over the die cavity 28, at which time the sequence of steps for compacting an article is repeated.

Figure 6:
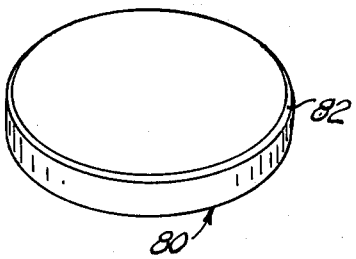
FIG. 6 is a perspective view of an example of article compacted by the apparatus of FIGS. 1–5.

It will be readily appreciated by those skilled in the art that the powder compacting apparatus of the invention thus permits to compact articles, such as the article 80 of FIG. 6 provided with a broken corner, rather than with a sharp corner, which, in the example of structure illustrated, is a beveled corner 82.

Figure 7:
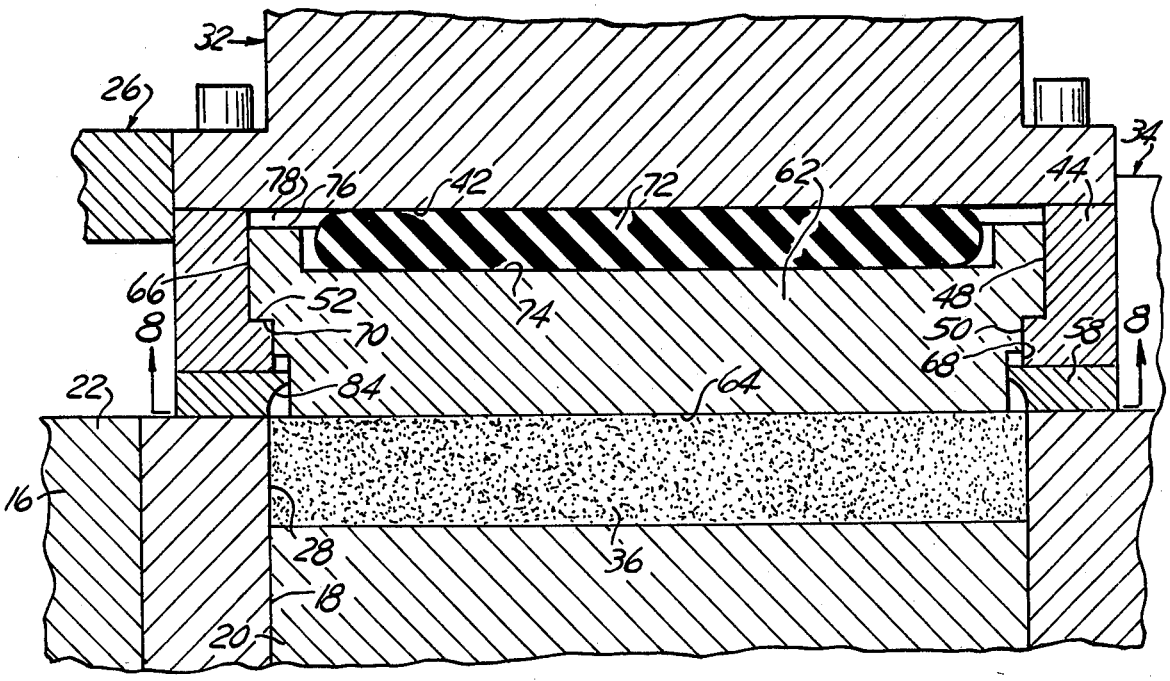
FIG. 7 is a partial broken sectional view similar to FIG. 1, but showing a modification of the invention.
Figure 8:
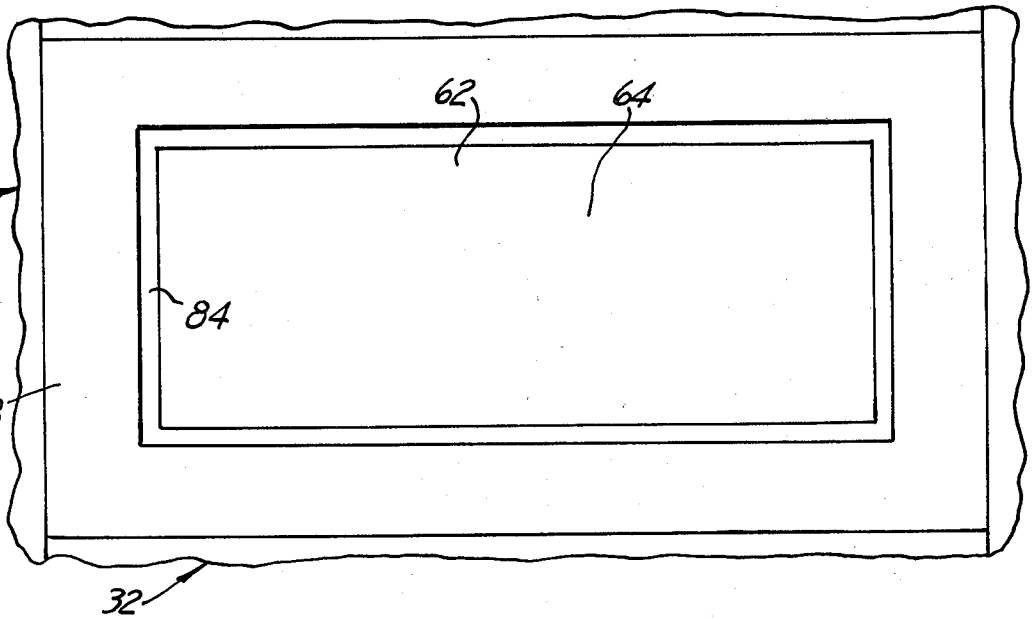
FIG. 8 is a bottom plan view thereof from line 8—8 of FIG. 7.
Figure 9:
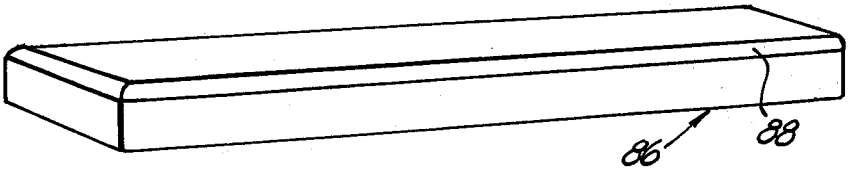
FIG. 9 is a perspective view of a compacted article made by the apparatus of FIGS. 7–8.

It will be evident to those skilled in the art that the article compacted from powder material by the apparatus of the invention can take whatever shape is appropriate according to the configuration of the die bore 18 and die cavity 28, the shape of the punch 22 and the punch face 30, and the configuration anvil movable pad 62, and that the broken corner of the finished article can be other than a beveled corner such as, for example, a radiused corner by providing the ring 58 with a radiused wall surface, as shown at 84 at FIGS. 7 and 8. Also, as illustrated at FIGS. 7–8, the ring 58 may be, for example, rectangular in plan view as shown, or it may have any other appropriate shape depending on the desired shape of the compacted article. In the example of structure of FIGS. 7–8, the anvil pad 62 is also provided with substantially rectangular face 64 which, together with a rectangular punch 20 and a parallelepipedonal die cavity 28 permit to obtain the parallelepipedonal article 86 of FIG. 9 provided with radiused corners 88 conforming to the radiused wall 84 of the ring 58.

Having thus described the present invention by way of structural examples of embodiments thereof, modifications whereof will be apparent to those skilled in the art, what is claimed as new is as follows:

1. In an apparatus for compacting power material into a compacted article, said apparatus comprising a stationary die plate, a bore in said die plate, a punch reciprocably movable in said bore and having an end face forming with a portion of said bore a die cavity controllably fillable with powder material, and an anvil assembly having a face positionable over said die cavity for compacting said article between said punch and said anvil surface, the improvement comprising the face of said anvil assembly having a stationary face portion and a movable face portion formed on the end of a pad movable relative to said stationary face portion from a position wherein said movable face portion is flush with the surface of said die plate to a position wherein said movable face portion is away from said surface, abutment means limiting the motion of said pad, and biasing means disposed behind said pad for urging said pad towards said die plate surface.

2. The improvement of claim 1 wherein said anvil assembly comprises a housing in which said pad is disposed, said housing having an end surface being normally in engagement with said die plate surface and forming an opening through which the end of said pad is disposed.

3. The improvement of claim 2 wherein said opening has a tapered wall.

4. The improvement of claim 2 wherein said opening has a radiused wall.

5. An anvil assembly for an anvil powder compacting press comprising a die, a bore in said die, a reciprocable punch in said bore having an end face for compacting power material placed in said bore above said punch end face between said punch end face and an anvil assembly, said anvil assembly comprising a housing, a bore in said housing, an anvil pad slidably retained at said bore, a surface on said anvil pad disosed toward said bore, first abutment means limiting the displacement of said anvil pad towards said die cavity, second abutment means limiting displacement of said anvil pad away from said die cavity during compaction of said powder material in said bore between said punch end face and said anvil pad surface, and biasing means disposed behind said anvil pad for urging said anvil pad towards said bore in said die.

6. The anvil assembly of claim 5 wherein said biasing means is an elastomeric cushion pad.

7. The anvil assembly of claim 5 wherein said anvil pad surface has an area less than the area of said die bore, and said housing has a portion surrounding said anvil pad surface, said portion forming an opening of progressively decreasing diameter directed towards said die bore.

8. The anvil assembly of claim 7 wherein said opening has a beveled wall.

9. The anvil assembly of claim 7 wherein said opening has a radiused wall.

10. An apparatus for compacting powder material into a solid article, said apparatus comprising a die plate, a bore in said die plate, a punch disposed reciprocable in said bore, a compacting face on an end of said punch, an anvil assembly controllably disposed over said bore, said anvil assembly comprising a housing having an end surface in engagement with said die plate and surrounding said bore, a cavity in said housing open towards said bore, an anvil pad slidably disposed in said cavity and having an end face disposed towards said bore, said end face having an area less than the area of said bore, first abutment means dependent from said housing and said anvil pad for limiting the displacement of said anvil pad towards said bore, second abutment means dependent from said housing and said anvil pad for limiting the displacement of said anvil pad away from said bore, biasing means constantly urging said first abutment means in mutual engagement, wherein the face of said housing in engagement with said die plate has an opening having a wall of progressively increasing diameter providing passage therethrough to the end face of said anvil pad and wherein during compaction of an article between said punch compacting face and said anvil pad end face said anvil pad is displaced away from said bore until said second abutments are in mutual engagement and said solid article is compacted in a molding cavity formed by said punch end face, said bore, said anvil pad end face, and said opening wall of progressively increasing diameter.

11. The apparatus of claim 10 wherein said opening wall is a tapered wall.

12. The apparatus of claim 10 wherein said opening wall is a radiused wall.

13. The apparatus of claim 10 wherein said biasing means is an elastomeric pad cushion.

14. A method for compacting powder material into a solid article in an apparatus comprising a die plate, a bore in said die plate, a punch disposed reciprocable in said bore and having a compacting face at an end thereof, and an anvil assembly controllably disposed over said bore, said anvil assembly having an end surface disposed over said bore, said end surface being in two separate portions and said method comprising placing a predetermined amount of said powder material in said bore, placing said anvil assembly over said bore, displacing said punch towards said end surface of the anvil assembly, allowing one of the portions of said end surface of said anvil assembly to be displaced in the same direction as the direction of displacement of said punch under the pressure applied by said punch end face upon said powder material, limiting the amount of displacement of said one of the portions of said anvil assembly end surface such as to finish compacting part of an article from said powder material against said one of the portions of said anvil assembly end surface in a stationary first position, simultaneously maintaining the other of the portions of said anvil assembly end surface in a stationary position such that said other of the portions of said anvil assembly end surface maintained in a stationary position forms another part of said compacted article, retracting said punch while allowing said one of the portions of said end surface of said anvil assembly to remain in engagement with said compacted article, limiting further displacement of said one of the portions of said end surface of said anvil assembly to a second position allowing said anvil assembly to be displaced from above said bore, removing said anvil assembly from above said bore, and displacing said punch in a direction ejecting said compacted article from said bore.

15. The method of claim 14 wherein said one of the portions of said anvil assembly and surface is constantly biased toward said second position.

* * * * *

UNITED STATES PATENT AND TRADEMARK OFFICE

CERTIFICATE OF CORRECTION

PATENT NO. : 4,401,614

DATED : August 30, 1983

INVENTOR(S) : Raymond P. DeSantis

It is certified that error appears in the above-identified patent and that said Letters Patent are hereby corrected as shown below:

Col. 5, line 58, correct the spelling of "disposed".

Signed and Sealed this

*Twenty-eighth* Day of *February 1984*

[SEAL]

*Attest:*

GERALD J. MOSSINGHOFF

*Attesting Officer*

*Commissioner of Patents and Trademarks*